US006888420B2

(12) United States Patent
Schaffner et al.

(10) Patent No.: US 6,888,420 B2
(45) Date of Patent: May 3, 2005

(54) RF MEMS SWITCH MATRIX

(75) Inventors: James H. Schaffner, Chatsworth, CA (US); Robert Y. Loo, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/407,056

(22) Filed: Apr. 3, 2003

(65) Prior Publication Data

US 2004/0095205 A1 May 20, 2004

Related U.S. Application Data

(60) Provisional application No. 60/426,672, filed on Nov. 14, 2002.

(51) Int. Cl.[7] ..... H01P 1/10
(52) U.S. Cl. ..... 333/101; 333/103
(58) Field of Search ..... 333/101, 103, 333/116, 258, 262, 104, 105

(56) References Cited

U.S. PATENT DOCUMENTS

| | | | | |
|---|---|---|---|---|
| 4,399,439 A | | 8/1983 | Upadhyayula | 340/825.91 |
| 4,731,594 A | | 3/1988 | Kumar | 333/103 |
| 5,117,207 A | | 5/1992 | Powell et al. | 333/1 |
| 5,309,006 A | | 5/1994 | Willems et al. | 257/275 |
| 5,446,424 A | | 8/1995 | Pierro | 333/104 |
| 5,629,241 A | | 5/1997 | Matloubian et al. | 438/125 |
| 5,696,470 A | | 12/1997 | Gupta et al. | 333/103 |
| 5,757,074 A | | 5/1998 | Matloubian et al. | 257/702 |
| 5,932,936 A | * | 8/1999 | Potthast et al. | 307/113 |
| 6,046,659 A | | 4/2000 | Loo et al. | 333/262 |
| 6,295,282 B1 | | 9/2001 | Buer et al. | 370/323 |
| 6,426,687 B1 | | 7/2002 | Osborn | 333/262 |
| 6,496,082 B1 | * | 12/2002 | DiPiazza | 333/101 |
| 6,741,207 B1 | * | 5/2004 | Allison et al. | 342/371 |
| 2002/0153531 A1 | | 10/2002 | Levine et al. | 257/110 |

FOREIGN PATENT DOCUMENTS

| | | | |
|---|---|---|---|
| GB | 2 373 373 A | 9/2002 | H01H/57/00 |

* cited by examiner

*Primary Examiner*—Linh My Nguyen
(74) *Attorney, Agent, or Firm*—Ladas & Parry, LLP

(57) ABSTRACT

A broadband multiple input, multiple output switch matrix. The switch matrix comprises multiple crosspoint switch element tiles. Each tile comprises RF MEMS switches disposed on a substrate to provide a crosspoint switching capability. The crosspoint switch element tiles are disposed in a flip-chip manner on the upper side of an RF substrate that provides RF connectivity between the various crosspoint switch element tiles. A bias line substrate disposed on the lower side of the RF substrate receives control signals for the crosspoint switch element tiles and routes the signals through the RF substrate using vias in the RF substrate.

39 Claims, 8 Drawing Sheets

RF MEMS SWITCH MATRIX

CROSS REFERENCE TO RELATED APPLICATIONS

The application claims the benefit of U.S. Provisional Application No. 60/426,672 filed on Nov. 14, 2002, the contents of which are incorporated herein by reference in their entirety.

BACKGROUND

1. Field

The present invention relates to an apparatus for switching multiple electrical inputs to multiple electrical outputs. More particularly, the present invention relates to a broadband RF micro electromechanical system (MEMS) switch matrix that can be scaled to a matrix size of M×N, where M comprises the number of RF input ports and N comprises the number of RF output ports.

2. Description of Related Art

The routing of RF signals may be accomplished by using a switching matrix. A switching matrix may be configured to map M signal input ports into N signal output ports. Switching matrices are found in many signal routing situations such as communications base-stations, switched beam antennas, or telecommunications transfer switches. FIG. 1 shows a typical application of a switch matrix 100 that is used to switch signals from and to satellite processing circuits 101, satellite up-links 102 and satellite downlinks 103.

Various methods and devices are known in the art for providing switch matrices that allow M inputs to be switched to N outputs. U.S. Pat. No. 4,399,439, issued Aug. 16, 1983 to L. C. Upadhyayula, describes an M by N switch matrix comprising M single pole input switches, each input switch having N throws, connected to N single pole output switches, each output switch having M throws. A total of M times N interconnects are required to connect the input switches to the output switches. Upadhyayula further discloses that the input and output switches may be fabricated from GaAs MESFET transistors to provide for switches useful at microwave frequencies. However, those skilled in the art would understand that scaling the Upadhyayula apparatus to a larger number of inputs and/or outputs would increase the size and complexity of the individual input and output switches and the size and complexity of the apparatus overall.

M by N switch matrices may be provided by multiple crossbar switches. U.S. Pat. No. 5,696,470, issued Dec. 9, 1997 to R. M. Gupta et al. discloses techniques for using multiple crossbar switches to accomplish 2×2 and 4×4 matrices. Gupta et al. further describe a solid-state electronic switching module capable of operating at microwave frequencies for providing for switching of signals at those frequencies. However, one skilled in the art would appreciate that scaling the devices disclosed by Gupta et al. to larger matrices would require increasing levels of integration or the provision of several discrete devices, which also increases the overall size and complexity of the switching matrix. Another crossbar switch capable of operating at microwave frequencies is disclosed in U.S. Pat. No. 5,309,006, issued May 3, 1994 to Willems et al. Switch matrices using the Willems et al. device would suffer from the same limitations discussed above for the Gupta et al. device.

Another well-known technique used for providing M×N switch matrices is through the use of a crosspoint switch matrix. FIG. 2 shows a schematic representation of a 4×4 crosspoint switch matrix 200. In the crosspoint switch depicted in FIG. 2, each RF input 201, 202, 203, 204 is connected to a corresponding row transmission line 211, 212, 213, 214. Each RF output 221, 222, 223, 224 is connected to a corresponding column transmission line 231, 232, 233, 234. Each row transmission line 211, 212, 213, 214 crosses each column transmission line 231, 232, 233, 234 at crosspoints 240. Connections across the crosspoints 240 and from the row transmission lines 211, 212, 213, 214 to the column transmission lines 231, 232, 233, 234 are provided by crosspoint switches 241, 242, 243. With the crosspoint switch matrix 200 depicted in FIG. 2, any of the RF inputs 201, 202, 203, 204 may be connected to any of the RF outputs 221, 222, 223, 224 by opening or closing the appropriate crosspoint switches 241, 242, 243. For example, to connect $RFIN_1$ to $RFOUT_3$, the crosspoint row transmission line switches 241 at points A and B are closed, the crosspoint column transmission line switches 242 at points D, E and F are closed, and the crosspoint switch 243 at point C is closed.

Crosspoint switch matrices have been fabricated using semiconductor devices. U.S. Pat. No. 5,446,424, issued Aug. 29, 1995 to J. A. Pierro, discloses a crosspoint switching matrix employing multilayer stripline and pin diode switching elements. Pierro discloses a multiple layer structure in which one layer contains row transmission lines and a separate layer contains column transmission lines. Pin diode arrays are placed in apertures within the structure to provide crosspoint switching among and between the row and column transmission lines. One skilled in the art will appreciate that the fabrication of the device according to Pierro may be quite complex, due to the need to fabricate the multiple layers and to insert the pin diode arrays at each crosspoint. Also, scaling the device according Pierro to a large number of signal inputs and/or outputs may also be difficult, due to the need to fabricate all of the row or column transmission lines within a single layer.

Therefore, there exists a need in the art for an apparatus and method that provides for switching multiple electrical inputs to multiple electrical outputs in a low cost and scalable fashion. Further, the apparatus and method should provide low insertion loss for the radio frequency signals to be switched and to provide high isolation between separate radio frequency signals over a broad bandwidth.

SUMMARY

Accordingly, the present invention provides an RF switching matrix that is preferably constructed using elemental tiles comprising RF MEMS switches. The use of elemental tiles allows the switch to be scalable to any size matrix, M×N, constrained only by insertion loss parameters. The low insertion loss and high isolation inherent in the RF MEMS switches enable larger switching matrices to be constructed than if other semiconductor switching devices, such as PIN diodes or FET switches, were used.

The elemental tile preferably comprises two input ports and two output ports. RF signals are preferably routed between the input ports and the output ports with RF MEMS switches and microstrip transmission line circuit components.

Embodiments of the present invention may also use an integrated RF motherboard layer on which the elemental switch tiles may be assembled. Embodiments of the present invention may also use an integrated motherboard DC layer that allows the RF MEMS switches in the elemental tiles to be actuated individually without interfering with the RF signals switched within the switch matrix.

Embodiments of the present invention provide bandwidth, scalability and cost advantages over switch matrix technology known in the art. The preferred use of RF MEMS switches in embodiments of the present invention as the switching devices provide the switch matrix with broad bandwidth. RF MEMS switches provide excellent insertion loss, less than 0.25 dB up to 40 GHz, and high isolation, 25–30 dB at 40 GHz. Therefore, signal insertion loss is minimized as multiple switches are traversed in the matrix. Semiconductor switch matrices based on diodes or transistors may be limited in bandwidth due to higher losses in the semiconductor material and frequency selective parasitic impedance. Scalability is provided by the preferred use of monolithic switch tile elements. The switch tile elements allow any size switch matrix to be easily constructed. Many prior art switch matrices are entirely monolithic, which requires that the entire layout of the M×N switch to be determined prior to fabrication. Cost advantages are achieved with embodiments of the present invention by fabricating the switch matrices on low cost substrate material. Further, the broad bandwidth of the preferred RF MEMS switches allow the switch tile elements to be used in a variety of applications at different frequency bands. Thus, the tiles can be designed for high yield fabrication.

A first embodiment of the present invention provides a switch element tile comprising a substrate and three switches disposed on that substrate. The first switch on the substrate operates to electrically connect a row input to a row output, the second switch operates to electrically connect a column input to a column output, and the third switch operates to electrically connect the row input to the column output. The switches preferably comprise MEMS switches, although other switching devices known in the art, such as field effect transistors or PIN diodes, may be used. Microstrip lines on the substrate may be used to conduct electrical energy between the inputs, the outputs and the switches.

A second embodiment of the present invention provides a switch matrix for switching any one of multiple signal inputs to any one of multiple signal outputs. The switch matrix comprises: an array of switch element tiles, each switch element tile having one or more switch element inputs and one or more switch element outputs, each switch element tile of the array being disposed to couple at least one switch element output of each switch element tile to a switch element input of an adjacent switch element tile or to one signal output of the multiple signal outputs; a radio frequency (RF) substrate layer on which the array of switch element tiles are disposed, the RF substrate layer coupling each one of the multiple signal inputs to a corresponding switch element input, the RF substrate layer coupling each one of the multiple signal outputs to a corresponding switch element output, and the RF substrate layer coupling the at least one switch element output of each switch element tile to the switch element input of said adjacent switch element tile; and a bias line substrate layer on which the RF substrate layer is disposed, the bias line substrate layer having a plurality of switch element control inputs, the bias line substrate layer directing the switch element control inputs to the switch element tiles. The switch element tiles preferably comprise the switch element tiles described immediately above.

A third embodiment of the present invention provides a method for connecting various ones of M inputs to various ones of N outputs. The method preferably comprises the steps of providing a plurality of crosspoint switch tiles, each crosspoint switch tile having a row input, a column input, a row output, and a column output and each crosspoint switch tile being switchably operable to couple said row input to said row output or said column output and to couple said column input to said row output or said column output; disposing the plurality of crosspoint switch tiles on an upper side of an radio frequency (RF) substrate, the upper side of said RF substrate having a plurality of microstrip lines; arranging the plurality of crosspoint switch tiles on the RF substrate in rows and columns, wherein the row input of each crosspoint switch tile in each row is electrically coupled to the row output of an adjacent crosspoint switch tile in the same row or to one input of the M inputs with at least one microstrip line of the plurality of microstrip lines and the column output of each crosspoint switch tile in each column is coupled to the column input of an adjacent crosspoint switch tile or to one output of the N outputs with at least one microstrip line of said plurality of microstrip lines; receiving crosspoint switch signals at a bias line substrate disposed on a lower side of the RF substrate; and routing the crosspoint switch signals to the plurality of crosspoint switch tiles with control lines disposed on the bias line substrate and bias vias disposed within the RF substrate.

DETAILED DESCRIPTION

The present invention will now be described more fully hereinafter with reference to the accompanying drawings, in which preferred embodiments of the invention are shown. This invention may be embodied in many different forms and should not be construed as limited to the embodiments set forth herein.

Figure 1:
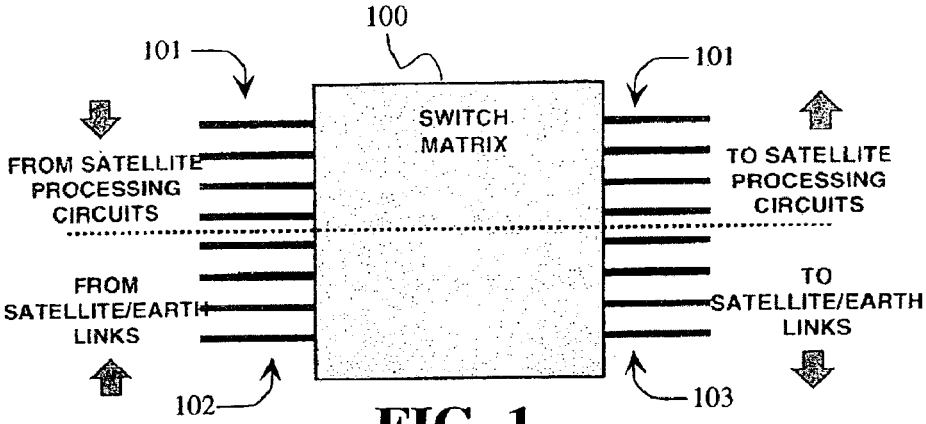
FIG. 1 (Prior Art)
FIG. 1 (prior art) shows a schematic representation of a switch matrix used for switching satellite signals.
Figure 2:
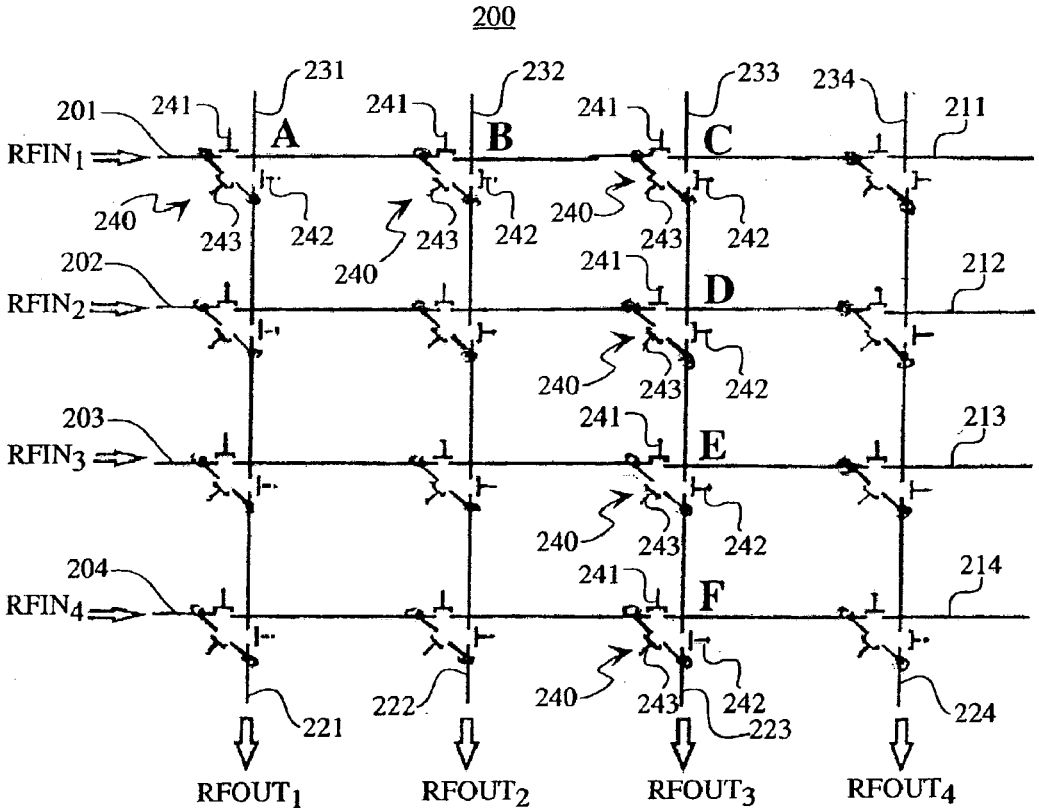
FIG. 2 (Prior Art)
FIG. 2 (prior art) shows a schematic representation of a 4×4 crosspoint switch matrix.

Preferred embodiments of the present invention provide a broadband switch matrix that may be scaled to a matrix size of M×N, where M is the number of input ports and N is the number of output ports. Embodiments of the present invention follow the same general architecture depicted in FIG. 2 of a crosspoint switch having row and column transmission lines and using switch devices to switch among and between the row and column transmission lines. However, embodiments of the present invention provide substantial improvement over prior art devices that use this crosspoint architecture.

Figure 3:
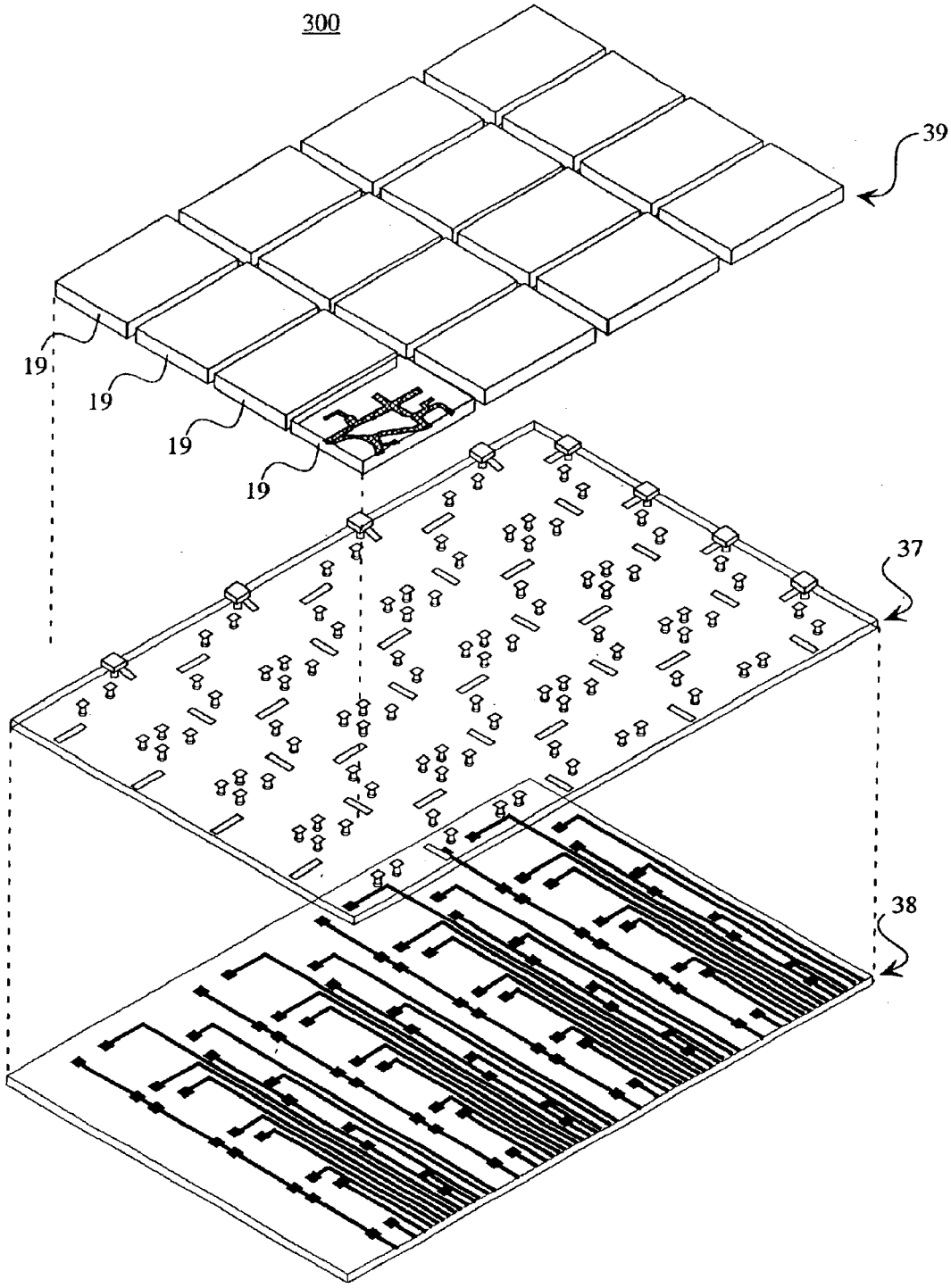
FIG. 3 shows a switch matrix according to an embodiment of the present invention.

A preferred embodiment of the present invention is shown in FIG. 3. FIG. 3 shows a switch matrix 300 comprising a switch element layer 39 consisting of one or more switch element tiles 19, an RF substrate layer 37 and a bias line substrate layer 38. The switch element tiles 19 in the switch element layer 39 contain switch devices used to route electrical signals. The switch element tile 19 preferably provides the same switching capability as that provided at the crosspoints 240 in the switch matrix 200 of FIG. 2 described above. The RF substrate layer 37 provides RF signals to be switched by the switch devices in the switch element tiles 19. The bias line substrate layer 38 provides the electrical signals used to power and control the switch devices in the switch element tiles 19. Each of these elements will be described in more detail below.

Switch Element Tile

Figure 4:
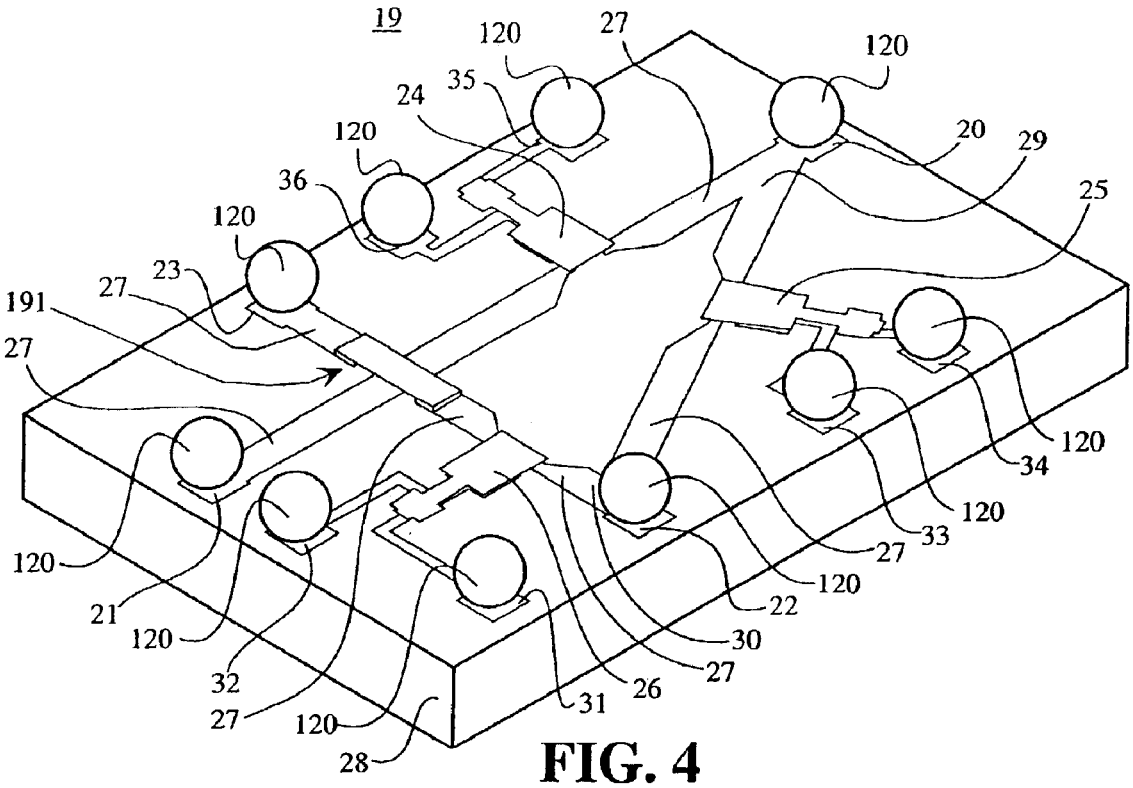
FIG. 4 shows a switch element tile according to an embodiment of the present invention.

A preferred embodiment of the switch element tile 19 is shown in FIG. 4. The switch element tile 19 preferably comprises three RF MEMS switches 24, 25, 26 switching across gaps in microstrip transmission lines 27. The RF MEMS switches 24, 25, 26 are preferably the electrostatically actuated metal contacting switches described in U.S. Pat. No. 6,046,659, issued Apr. 4, 2000 to Loo et al. and incorporated herein by reference, although other MEMS switches known in the art may be used. The switch element tile 19 is preferably fabricated on a semi-insulating GaAs substrate 28 in a manner described in U.S. Pat. No. 6,046,659, although other substrates and manners of fabrication may be used. The microstrip transmission lines 27 are preferably fabricated on the same side of the substrate 28 on which the RF MEMS switches 24, 25, 26 are disposed. The side of the substrate 28 opposite the RF MEMS switches 24, 25, 26 and the microstrip transmission lines 27 may be metallized to provide additional RF shielding capabilities. However, such metallization may lead to problems with parasitic capacitance. Hence, modeling of the effect of metallizing the opposite side of the substrate 28 should be performed to determine if the problems with parasitic capacitance and other signal altering effects outweigh the benefits of the additional shielding.

As shown in FIG. 4, the preferred embodiment of the switch element tile 19 has four RF signal ports 20, 21, 22, 23. Opening and closing the RF MEMS switches 24, 25, 26 provide the capability to make connections between the RF signal ports 20, 21, 22, 23. For example, the row RF input signal port 20 can be connected to the row RF output signal port 21 by closing the row switch 24. The row RF signal ports 20, 21 are isolated from the column RF signal ports 22, 23 by opening the cross switch 25. The row RF signal input port 20 can be connected to the column RF signal output port 22 by closing the cross switch 25. That connection is isolated from the row RF signal output port 21 and the column RF signal input port 23 by opening the row switch 24 and the column switch 26. Finally, column RF signal input port 23 can be connected to column RF signal output port 22 by closing column switch 26. The connection between the column RF signal ports 22, 23 is isolated from the row RF signal ports 20, 21 by opening cross switch 25.

In the embodiment depicted in FIG. 4, a first microstrip branch 29 is coupled to row RF signal input port 20 to route signals to either row RF signal output port 21 or column RF signal output port 22. A second microstrip branch 30 is coupled to column RF signal output port 22 to receive signals either from the row RF signal input port 20 or the column RF signal input port 23. Techniques well-known in the art may be used to fabricate the microstrip branches 29, 30. Techniques used in fabricating microstrip branches in microwave monolithic integrated circuits (MMICs) are particularly well-suited for use in fabricating the microstrip branches of embodiments of the present invention.

Figure 5:
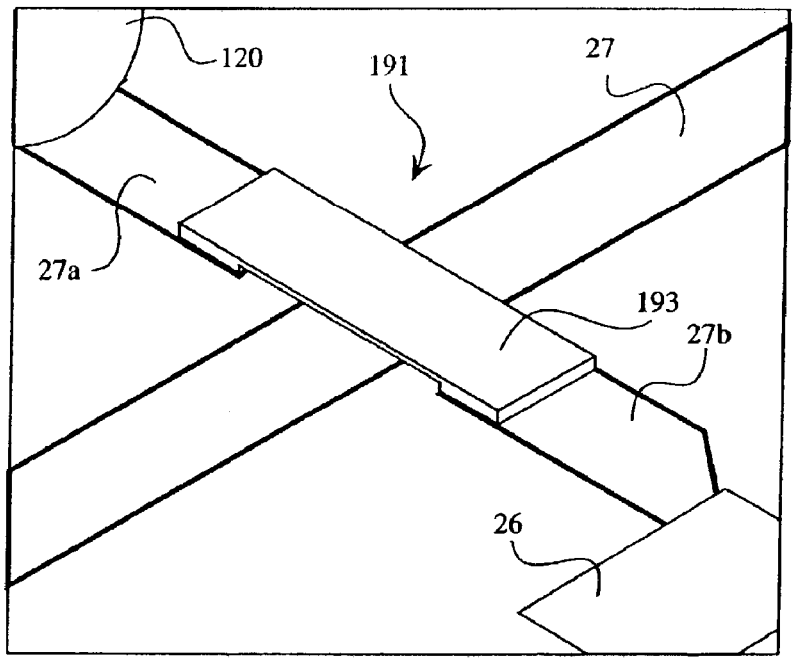
FIG. 5 shows a close-up view of an embodiment of an air bridge used in the switch element tile depicted in FIG. 4.

An airbridge 191 is used to route a signal from the column RF signal input port 23 to the column RF signal output port 22 at the point where the signal must cross the microstrip line 27 that connects the row RF signal input port 20 to the row RF signal output port 21. An enlarged view of the airbridge 191 is shown in FIG. 5. FIG. 5 depicts the airbridge 191 comprising an airbridge conductor 193 fabricated so as to provide an electrical connection between two parts of the microstrip transmission line 27*a* and 27*b*, while being electrically isolated by an air or dielectric gap from the microstrip transmission line 27 running beneath the conductor 193. The airbridge 191 may be fabricated using MMIC fabrication techniques. Such MMIC techniques are well-known in the art. For example, see U.S. Pat. No. 5,117,207, issued May 26, 1992 to Powell et al. and incorporated herein by reference, for methods used to fabricate an airbridge. An alternative approach for forming an airbridge by disposing the airbridge connector 193 on the RF substrate layer 37 is discussed below.

Returning now to FIG. 4, actuation voltages for opening and closing the switches 24, 25, 26 are applied to the actuation bias pads 31, 32, 33, 34, 35, 36. The row switch 24 is actuated by applying a voltage between the row switch actuation bias pads 35, 36. The column switch 26 is actuated by applying a voltage between the column switch actuation bias pads 31, 32. The cross switch 25 is actuated by applying a voltage between the cross switch actuation bias pads 33, 34. Some of the bias pads 31, 32,33, 34, 35, 36 may be connected to a common ground line.

Preferably, the switch element tile 19 is fabricated for flip-chip attachment to a motherboard. Solder bumps 120 may be disposed at the signal ports 20, 21, 22, 23 and/or the actuation bias pads 31, 32, 33, 34, 35, 36 to facilitate flip-chip attachment. The use of flip-chip connections for microwave circuits and methods of manufacturing solder bumps are described in U.S. Pat. No. 5,629,241, issued May 13, 1997 to Matloubian et al., and U.S. Pat. No. 5,757,074, issued May 26, 1998 to Matloubian et al., both incorporated herein by reference. The solder bumps 120 preferably have heights that are at least an order of magnitude greater than the heights of the switches 24, 25, 26 when they are in the open position, so that flip-chip assembly of the switch element tile 19 onto a motherboard will not interfere with the operation of the switches 24, 25, 26.

The switch element tile 19 described above discusses the use of RF MEMS switches to provide switch devices for routing the electrical signals within the tile 19. However, alternative embodiments of the switch tile may use solid state devices for providing the requisite switching. For example, field effect transistors (FETs) or PIN diodes may be used in place of the RF MEMS switches 24, 25, 26 shown in FIG. 4. Use of solid state devices for the switch devices should not impact the design or fabrication of the RF substrate layer 37, described below, but the bias line substrate layer 38, also described below, may change due to the use of different switch control voltages or currents.

The switch element tile 19 depicted in FIG. 3, using the elements and methods discussed above, may be fabricated to achieve dimensions of approximately 1.8 mm by 1.2 mm. Hence, one skilled in the art would appreciate that embodiments of the present invention provide a very compact crosspoint switching capability.

RF Substrate Layer

Figure 6:
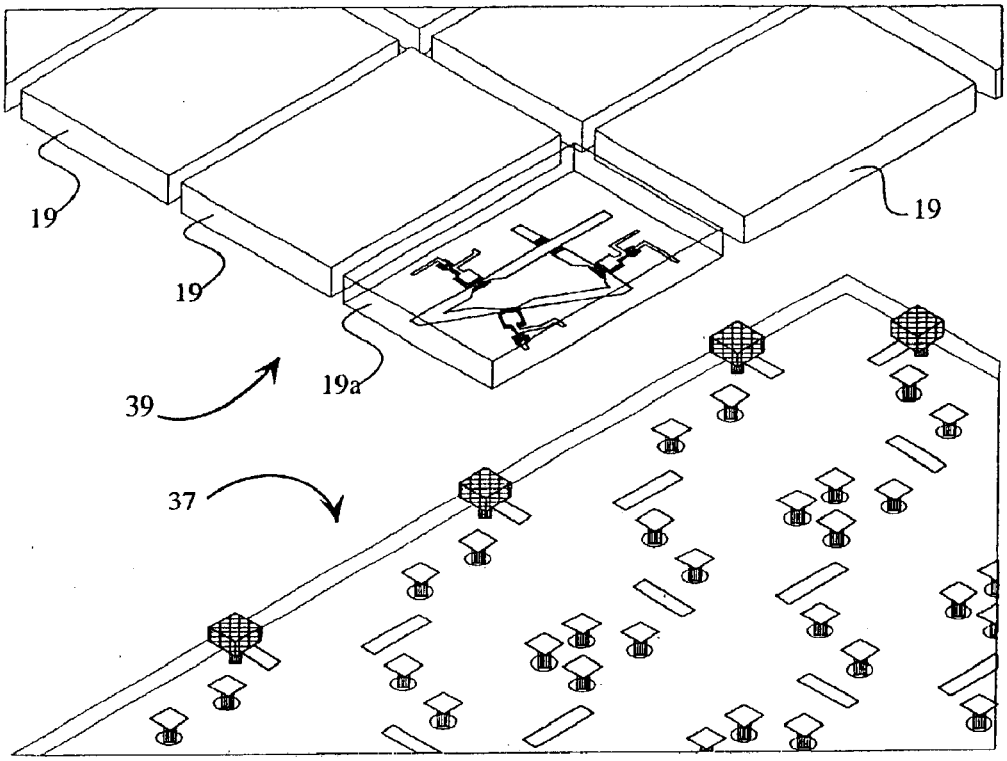
FIG. 6 shows an enlarged section of a switch array and an RF substrate layer according to embodiments of the present invention.

As shown in FIG. 3, preferred embodiments of the present invention have an RF substrate layer 37 on which one or more of the switch element tiles 19 discussed above are assembled. The RF substrate layer 37 may be fabricated from commercially available printed circuit board material so as to provide a motherboard for the switch element tiles 19. Preferably, the RF substrate layer 37 is fabricated from a low-loss material such as Rogers Duroid®. However, the exact material used will depend upon the particular application for the switch matrix. As discussed above, the switch element tiles 19 are fabricated on the RF substrate layer 37 so as to form a switch array 39 of switch tiles 19. FIG. 6 shows an enlarged section of the switch array 39 and the RF substrate layer 37. In FIG. 6, one of the switch element tiles 19*a* is shown semi-transparently to depict the orientation of the switch element tile 19*a* with the RF substrate layer 37.

Figure 7:
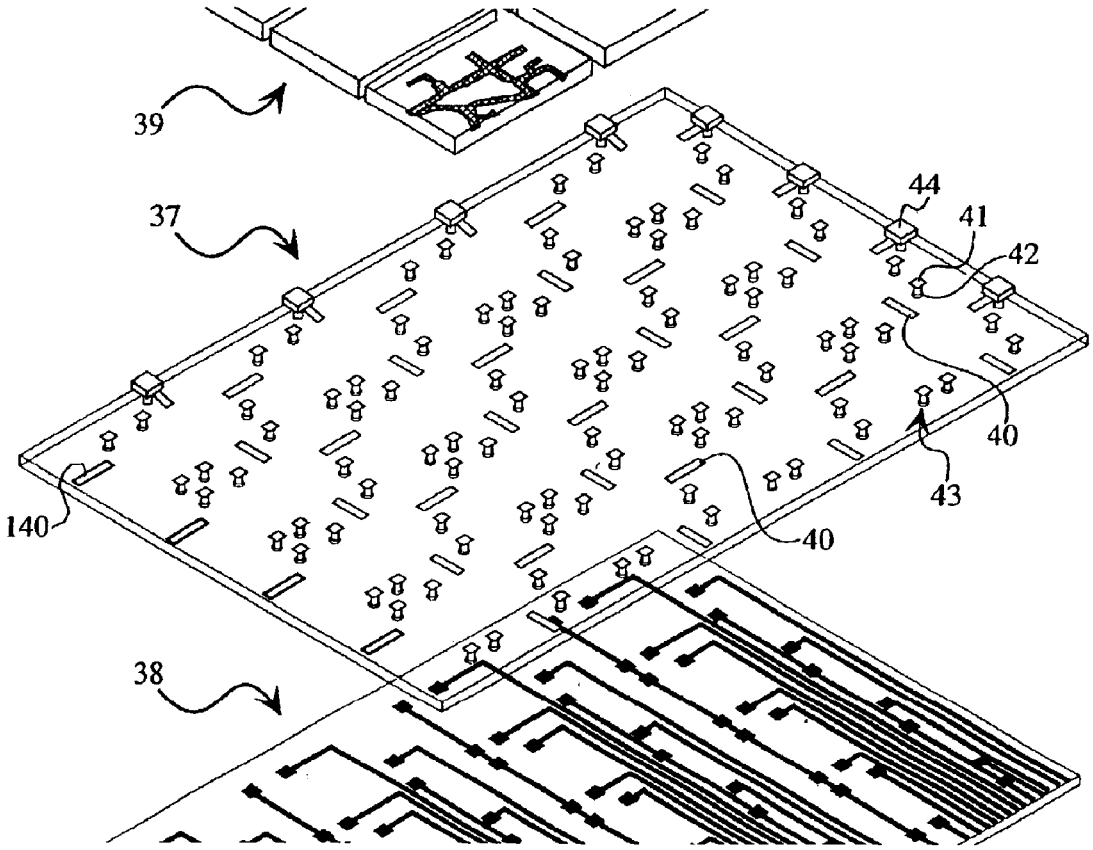
FIG. 7 shows the orientation of the RF substrate layer in relation to the switch array and a bias line substrate layer according to embodiments of the present invention.

A close-up view of the RF substrate layer 37 is shown in FIG. 7. On the top surface of this layer 37 are microstrip lines 40 and upper solder pads 41. The upper solder pads 41 are connected to plated via holes 42, which extend all the way through the layer 37 and terminate on lower solder pads 43 on the lower surface of the layer 37. Preferably, the lower surface of the RF substrate layer 37 is mostly metallized, except in the vicinity of the lower solder pads 43 on the lower surface, where the metal has been removed to provide electrical isolation from the via holes 42. Since the lower solder pads 43 on the lower surface of the RF substrate layer 37 are localized, they should have minimal performance impact on the microstrip lines 40 disposed on the upper surface of the RF substrate layer 37.

The microstrip lines 40 are fabricated according to techniques well-known in the art. Therefore, the microstrip transmission lines 40 may comprise materials typically used for microstrip transmission lines in MMICs, such as gold alloys. Further, the widths and thicknesses of the microstrip lines 40 are also fabricated according to techniques well-known in the art for achieving certain performance characteristics. For example, the widths of the microstrip transmission lines 40 may depend upon the dielectric and thickness of the material comprising the RF substrate layer 37. Generally, a lower dielectric of the material used for the RF substrate layer 37 means that a wider microstrip transmission line 40 must be fabricated. However, the thicknesses, widths, and materials used for the microstrip transmission lines 40 will be selected based on the overall performance characteristics required.

Figure 8:
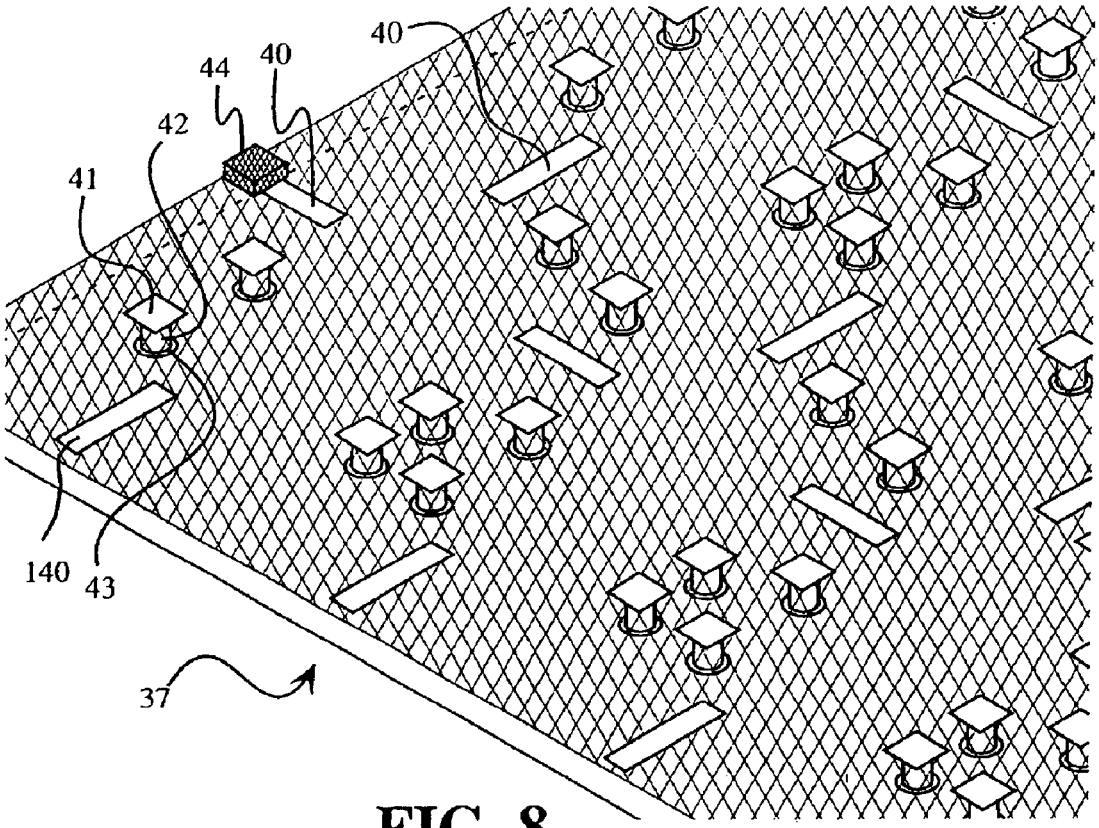
FIG. 8 shows a close-up view of the RF substrate layer to highlight microstrip lines deposited on the layer and the bias line vias disposed within the layer.

A close-up semi-transparent view of the RF substrate layer 37 is shown in FIG. 8. The microstrip lines 40 and the upper solder pads 41 are fabricated on the layer 37 in such a way that they align with the switch element tiles 19. The switch element tiles 19 are assembled onto the RF substrate layer 37 so that the microstrip lines 40 connect one tile 19 to the next, as shown in the top view in FIG. 9 (discussed in additional detail below). The actuation bias pads 31, 32, 33, 34, 35, 36 of the tiles 19 align with the upper solder pads 41 of the RF substrate layer 37. Preferred embodiments of the present invention may also have chip terminations 44 disposed at the unused ports. The terminating loads of the chip terminations 44 help maintain isolation of the switch in that any energy coupled into the ports with terminating loads will not be reflected back into the switch circuits. The chip terminations 44 also allow for a signal to be switched into a load instead of one of the output ports. Input and output microstrip lines 140 are used to couple signals to and from the RF substrate layer 37. One skilled in the art would understand that various devices known in the art, such as RF connectors or adapters, may be used to couple RF signals to the input microstrip lines 140 and from the output microstrip lines 140.

An alternative embodiment of the RF substrate layer 37 comprises additional microstrip lines to provide the airbridge used to route a signal from the column RF signal input port 23 to the column RF signal output port 22 of the switch element tile 19. Instead of disposing the airbridge directly on the switch element tile 19, as discussed above, the microstrip lines connecting to the column RF signal input and output ports 22, 23 are terminated with solder balls or some other means to provide an electrical connection to the RF substrate layer 37. Microstrip lines are disposed on the RF substrate layer 37 to provide an electrical connection between the column RF signal input port 23 and the column RF signal output port 22 while electrically isolating these ports from the transmission line between the row input and output ports 20, 21.

Bias Line Substrate Layer

Figure 10:
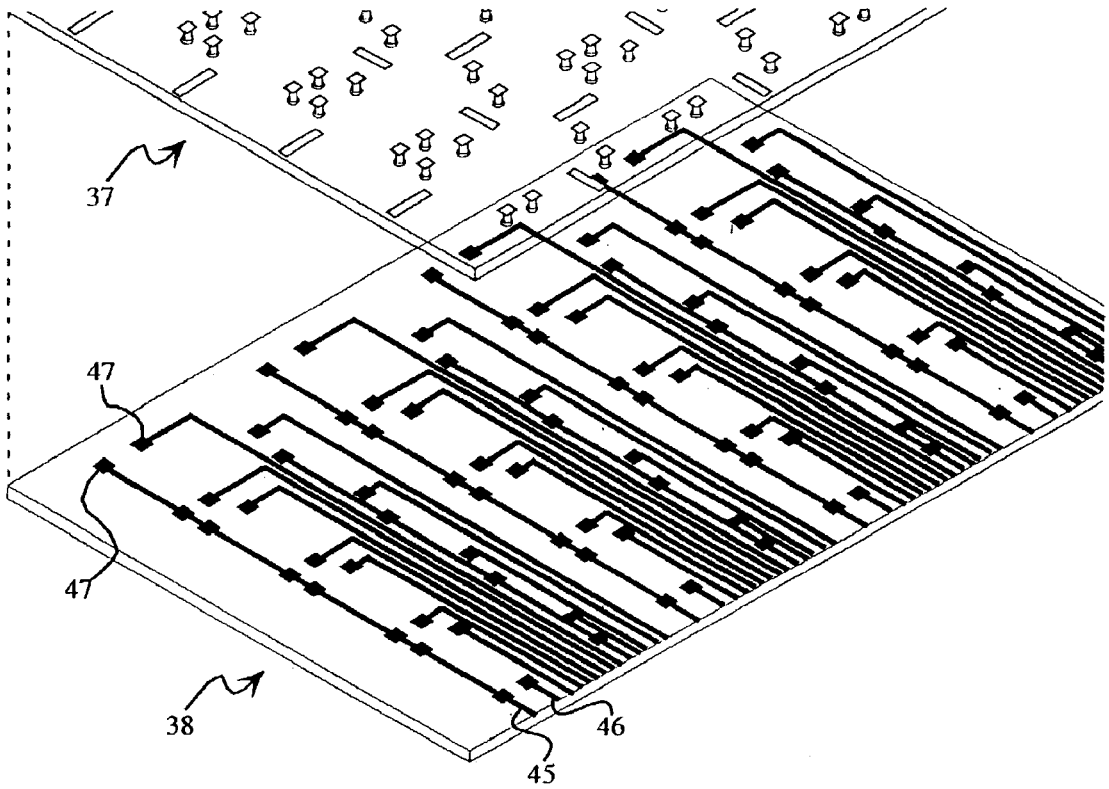
FIG. 10 shows a portion of the RF substrate layer and the entire bias line substrate layer to depict the alignment of the two layers.

As shown in FIG. 3, preferred embodiments of the present invention have a bias line substrate layer 38 on which the RF substrate layer 37 is assembled. The bias line substrate layer 38 may be fabricated from commercially available printed circuit board material using multi-layer board lamination and plated via hole techniques. As discussed above, the RF substrate layer 37 is disposed on the bias line substrate layer 38. FIG. 10 shows a portion of the RF substrate layer 37 and the bias line substrate layer 38 to depict the alignment of the two layers.

As shown in FIG. 10, the bias line substrate layer 38 preferably contains metal lines 45, 46, which bring the switch actuation voltages to bias line solder pads 47 that are aligned with the solder pads 43 on the lower surface of the RF substrate layer 37. In this way, the actuation voltages are brought through the plated via holes 42 in the RF substrate layer 37 to the actuation pads of the flip-chip oriented switch element tiles 19. A common line 45 may be used to provide a ground line to multiple switch element tiles 19 (instead of multiple lines) to save space on the bias line substrate layer 38. One skilled in the art would understand that various devices, such as standard connectors, may be used to couple actuation voltages to the metal lines 45, 46.

The RF substrate layer 37 and the bias line substrate layer 38 may be fabricated using multiple layer circuit board techniques well-known in the art. The necessary elements in the RF substrate layer 37 and the bias line substrate layer 38, such as bias lines, microstrip lines, solder pads, vias, etc., are then fabricated using these well-known multiple layer techniques. Further, using such techniques, the RF substrate layer 37 and the bias line substrate layer 38 may both each actually comprise several layers to provide the necessary board layout and performance characteristics. Also, materials used in the RF substrate layer 37 and the bias line substrate layer 38 are selected to provide the necessary electrical isolation and structural characteristics. The combination of the RF substrate layer 37 and the bias line substrate layer 38 fabricated using multiple layer circuit board techniques may be considered as a motherboard for the switch element tiles 19.

Figure 11:
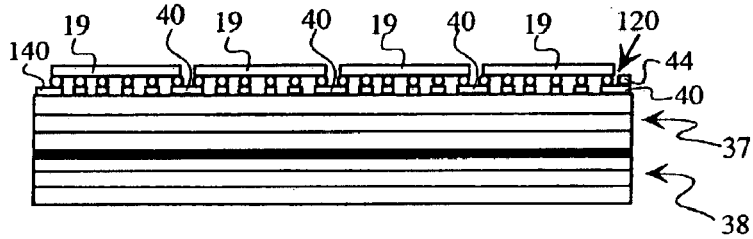
FIG. 11 shows a side view of an embodiment of the invention where the substrate layer and the bias line substrate layer comprise multiple layers.

FIG. 11 depicts an embodiment of the present invention where the RF substrate layer 37 and the bias line substrate layer 38 comprise several layers. While FIG. 11 shows that the RF substrate layer 37 and the bias line substrate layer 38 each comprise only three layers, the RF substrate layer 37 and the bias line substrate layer 38 may each comprise more or less than three layers. FIG. 11 further shows the disposition of the switch element tiles 19 in a flip-chip fashion on top of the RF substrate layer 37. Solder balls 120 provide the electrical connections to the microstrip lines 40, solder pads 42, and input and output microstrip lines 140 on the RF substrate layer 37. The microstrip lines 40 also provide the electrical connections between adjacent switch element tiles 19.

As previously discussed, flip-chip techniques may be used to assemble the switch element tile 19 on the RF substrate layer 37. Such techniques would generally utilize registration marks provided on the RF substrate layer 37 to properly align the switch element tiles 19 to the RF substrate layer 37. Hence, the RF substrate layer 37 is preferably fabricated with such registration marks. The assembly of the switch element tiles 19 to the RF substrate layer 37 may then be accomplished using fabrication techniques similar to those used for ball grid array (BGA) chips. Such techniques are well-known in the art.

Switch Matrix Structure and Operation

Figure 9:
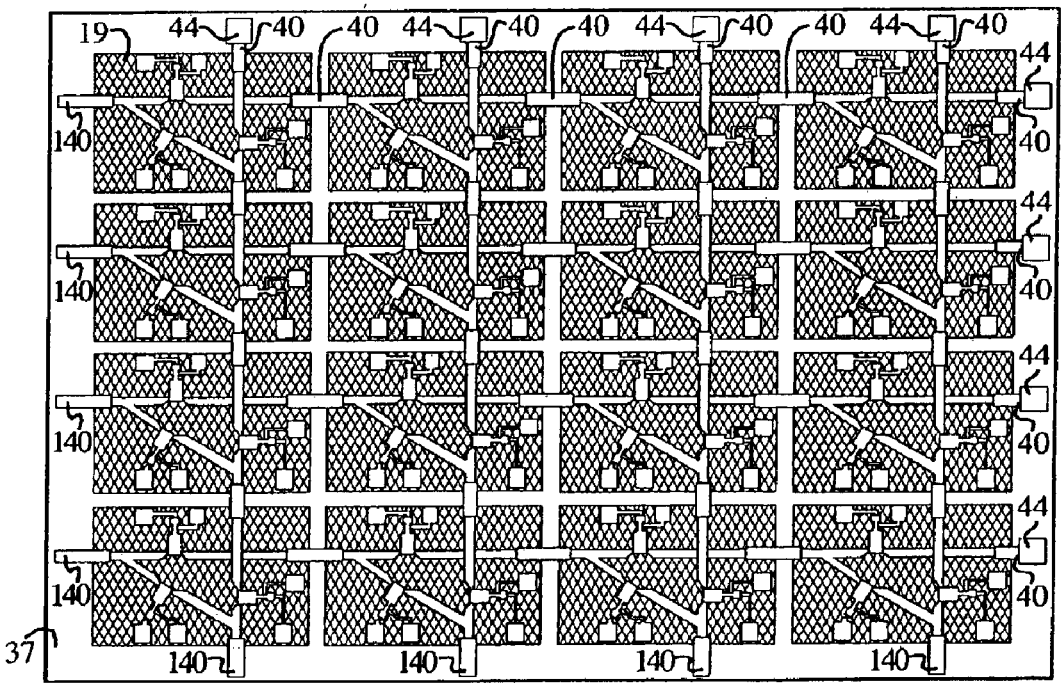
FIG. 9 shows a top view of a 4×4 switch matrix according to an embodiment of the present invention.

FIG. 9 depicts a top view of a 4×4 switch matrix assembly according to the present invention. The dimensions of the 4×4 switch matrix depicted in FIG. 9 are approximately 8.6 mm by 5.8 mm using current fabrication techniques. However, the dimensions of the switch matrix are not limited by the embodiments or fabrication techniques discussed herein. Smaller or larger dimension 4×4 switch matrices may be obtained, for example, by using alternative fabrication techniques, alternative element layouts, or alternative elements.

As shown in FIG. 9, sixteen switch element tiles 19 are disposed on the RF substrate layer 37 to provide for the switching of any of four inputs to any of four outputs. As previously described, microstrip lines 40 couple the output ports of each switch element tile 19 to the input ports of the adjacent switch element tiles 19. Chip terminators 44 are disposed opposite the switch matrix input ports and the switch matrix output ports to provide appropriate terminations for the transmission lines within the switch matrix assembly. Control of the switches within the switch element tiles is provided by voltages carried to the switches by the bias via holes 42 (shown in FIGS. 7 and 8). Signals are coupled into and out of the switch matrix using the input and output microstrip lines 140.

Figure 12:
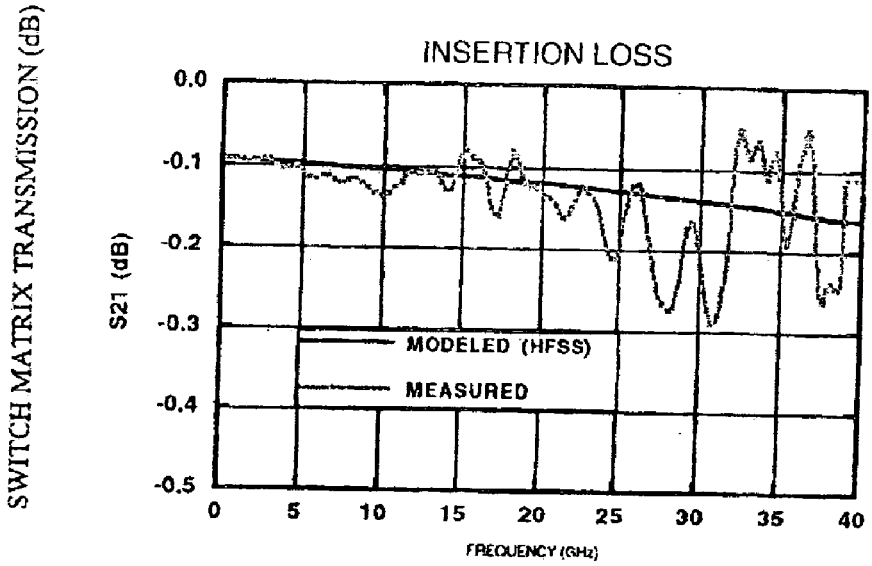
FIG. 12 compares the modeled insertion loss to the measured insertion loss of an RF MEMS switch capable for use within embodiments of the present invention.
Figure 13:
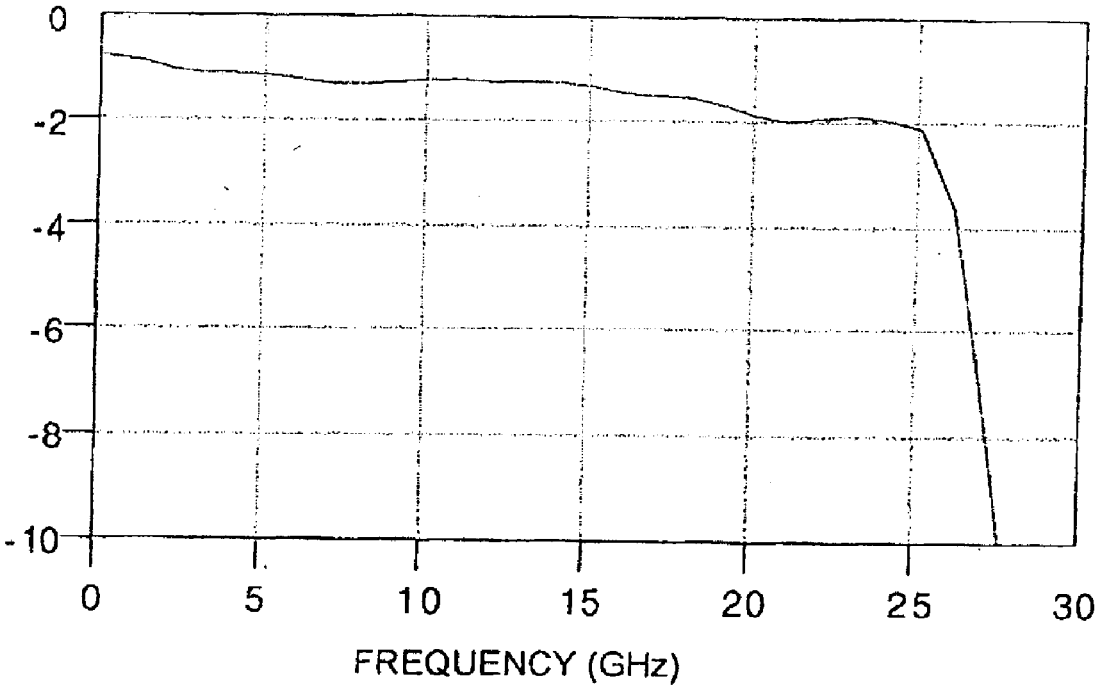
FIG. 13 shows the modeled insertion loss for the longest path within a 4×4 switch matrix according to an embodiment of the present invention.

A model of the 4×4 RF MEMS switch depicted in FIG. 9 was performed based on using two modeling tools: 1) Agilent's HFSS® for modeling individual switch insertion loss, and 2) Agilent's ADS® for circuit modeling of the switch tiles and the four-by-four switch matrix. An example of the modeled switch insertion loss is shown in FIG. 12, where a comparison is made to the measured insertion of an RF MEMS switch. This model provided the input and output insertion loss and isolation parameters needed to model the individual switch tiles. The insertion loss through the longest signal path of the 4×4 switch matrix described above is shown in FIG. 13. The signal must travel through 7 RF MEMS switches along this path. The rapid increase of the insertion loss above 25 GHz is caused by the small but finite reflection coefficient of each individual switch and the length of microstrip line between the switches.

From the foregoing description, it will be apparent that the present invention has a number of advantages, some of which have been described above, and others of which are inherent in the embodiments of the invention described above. Also, it will be understood that modifications can be made to the method described above without departing from the teachings of subject matter described herein. As such, the invention is not to be limited to the described embodiments except as required by the appended claims.

What is claimed is:

1. A switch element tile comprising:

a substrate;

a first switch disposed on said substrate, the first switch operable to electrically connect a row input to a row output;

a second switch disposed on said substrate, the second switch operable to electrically connect a column input to a column output; and a third switch disposed on said substrate, the third switch operable to electrically connect the row input to the column output.

2. The switch element tile of claim 1, wherein at least one switch of the group consisting of the first switch, the second switch, and the third switch is a radio frequency (RF) micro electromechanical system (MEMS) switch.

3. The switch element tile of claim 1 further comprising:

a first pair of actuation bias pads disposed on said substrate, said first pair of actuation bias pads coupled to said first switch to provide a control signal to selectably switch said first switch;

a second pair of actuation bias pads disposed on said substrate, said second pair of actuation bias pads coupled to said second switch to provide a control signal to selectably switch said second switch; and a third pair of actuation bias pads disposed on said substrate, said third pair of actuation bias pads coupled to said third switch to provide a control signal to selectably switch said third switch.

4. The switch element tile of claim 1 further comprising:

a first switch element microstrip line disposed on said substrate, said first switch element microstrip line having a first input segment electrically coupled to said row input and having a first output segment electrically coupled to said row output, said first switch operable to electrically connect said first input segment to said first output segment;

a second switch element microstrip line disposed on said substrate, said second switch element microstrip line having a second input segment electrically coupled to said column input and having a second output segment electrically coupled to said column output, said second switch operable to electrically connect said second input segment to said second output segment, said second switch element microstrip line being electrically isolated from said first switch element microstrip line; and a third switch element microstrip line disposed on said substrate, said third switch element microstrip line having a third input segment electrically coupled to said row input and having a third output segment electrically coupled to said column output, said third switch operable to electrically connect said third input segment to said third output segment.

5. The switch element tile of claim 4, wherein said second switch element microstrip line further comprises an airbridge to provide electrical isolation from said first switch element microstrip line.

6. The switch element tile of claim 5, wherein said airbridge is fabricated using microwave monolithic integrated circuit techniques.

7. The switch element tile of claim 5, wherein said airbridge is formed by assembling said switch element tile on a second substrate, said second substrate having at least one microstrip line providing electrical continuity within said second switch element microstrip line.

8. The switch element tile of claim 4 further comprising:

a first microstrip branch disposed on said substrate, said first microstrip branch being electrically coupled to said row input, said first input segment and said third input segment; and a second microstrip branch disposed on said substrate, said second microstrip branch being electrically coupled to said column output, said second output segment and said third output segment.

9. The switch element tile of claim 1, further comprising:

a row input pad disposed on said substrate, said row input pad coupled to said row input;

a row output pad disposed on said substrate, said row output pad coupled to said row output;

a column input pad disposed on said substrate, said column input pad coupled to said column input;

a column output pad disposed on said substrate, said column output pad coupled to said column output; and one or more solder bumps disposed on at least one pad of the group of pads consisting of said row input pad, said row output pad, said column input pad, and said column output pad.

10. The switch element tile of claim 1 wherein said substrate has an upper surface and a lower surface, said first switch, said second switch, and said third switch are disposed on said upper surface and said lower surface is metallized.

11. The switch element tile of claim 2, wherein said MEMS switch is an electro-statically actuated MEMS switch.

12. The switch element of claim 1, wherein at least one switch of the group consisting of the first switch, the second switch, and the third switch comprises a field effect transistor or a PIN diode.

13. A switch matrix for switching any one of multiple signal inputs to any one of multiple signal outputs, said switch matrix comprising:

an array of switch element tiles, each switch element tile having one or more switch element inputs and one or more switch element outputs, each switch element tile of said array being disposed to couple at least one switch element output of each switch element tile to a switch element input of an adjacent switch element tile or to one signal output of said multiple signal outputs;

a radio frequency (RF) substrate layer on which said array of switch element tiles is disposed, said RF substrate layer coupling each one of said multiple signal inputs to a corresponding switch element input, said RF substrate layer coupling each one of said multiple signal outputs to a corresponding switch element output, and said RF substrate layer coupling said at least one switch element output of each switch element tile to said switch element input of said adjacent switch element tile; and a bias line substrate layer on which said RF substrate layer is disposed, said bias line substrate layer having a plurality of switch element control inputs, said bias line substrate layer directing said switch element control inputs to said switch element tiles.

14. The switch matrix according to claim 13, wherein the array of switch element tiles are arranged in rows and columns and the one or more switch element inputs of each switch element tile comprise a row input and a column input and the one or more switch element outputs of each switch element tile comprise a row output and a column output and each switch element tile operates to switchably couple said row input to said row output or said column output and to switchably couple said column input to said column output or said row output.

15. The switch matrix according to claim 14, wherein at least one switch element tile comprises:

a substrate;

a first MEMS switch to switchably couple said row input to said row output;

a second MEMS switch to switchably couple said column input to said column output; and a third MEMS switch to switchably couple said row input to said column output;

wherein said first MEMS switch, said second MEMS switch, and said third MEMS switch are disposed on said substrate.

16. The switch matrix according to claim 15, wherein said at least one switch element tile further comprises:

a first pair of actuation bias pads disposed on said substrate, said first pair of actuation bias pads coupled to said first switch to provide a control signal to selectably switch said first MEMS switch;

a second pair of actuation bias pads disposed on said substrate, said second pair of actuation bias pads coupled to said second switch to provide a control signal to selectably switch said second MEMS switch; and a third pair of actuation bias pads disposed on said substrate, said third pair of actuation bias pads coupled to said third switch to provide a control signal to selectably switch said third MEMS switch.

17. The switch matrix according to claim 15, wherein said at least one switch element tile further comprises:

a first switch element microstrip line disposed on said substrate, said first switch element microstrip line having a first input segment electrically coupled to said row input and having a first output segment electrically coupled to said row output, said first switch operable to electrically connect said first input segment to said first output segment;

a second switch element microstrip line disposed on said substrate, said second switch element microstrip line having a second input segment electrically coupled to said column input and having a second output segment electrically coupled to said column output, said second switch operable to electrically connect said second input segment to said second output segment, said second switch element microstrip line being electrically isolated from said first switch element microstrip line; and a third switch element microstrip line disposed on said substrate, said third switch element microstrip line having a third input segment electrically coupled to said row input and having a third output segment electrically coupled to said column output, said third switch operable to electrically connect said third input segment to said third output segment.

18. The switch matrix according to claim 17, wherein said second switch element microstrip line further comprises an airbridge to provide electrical isolation from said first switch element microstrip line.

19. The switch matrix according to claim 18, wherein said airbridge is fabricated using microwave monolithic integrated circuit techniques.

20. The switch matrix according to claim 18, wherein said airbridge comprises at least one microstrip line disposed on said RF substrate layer, said microstrip line providing electrical continuity within said second switch element microstrip line.

21. The switch matrix according to claim 15, wherein said at least one switch element tile further comprises:

a first microstrip branch disposed on said substrate, said first microstrip branch being electrically coupled to said row input, said first input segment and said third input segment; and a second microstrip branch disposed on said substrate, said second microstrip branch being electrically coupled to said column output, said second output segment and said third output segment.

22. The switch matrix of claim 15, wherein said at least one switch element tile further comprises:

a row input pad disposed on said substrate, said row input pad coupled to said row input;

a row output pad disposed on said substrate, said row output pad coupled to said row output;

a column input pad disposed on said substrate, said column input pad coupled to said column input;

a column output pad disposed on said substrate, said column output pad coupled to said column output; and one or more solder bumps disposed on at least one pad of the group of pads consisting of said row input pad, said row output pad, said column input pad, and said column output pad.

23. The switch matrix according to claim 13, wherein said RF substrate layer has an upper RF substrate surface and a lower RF substrate surface, said RF substrate layer comprising:

a plurality of bias vias extending from said lower RF substrate surface to said upper RF substrate surface, said plurality of bias vias electrically connecting said plurality of switch element control inputs to said switch element tiles; and a plurality of microstrip lines, selected ones of said microstrip lines electrically connecting each output of each switch element tile to an input of an adjacent switch element tile or to a signal output of said multiple signal outputs.

24. The switch matrix according to claim 23, wherein said bias line substrate layer comprises:

a plurality of bias line solder pads, each bias line solder pad being disposed to electrically contact a corresponding bias via; and a plurality of bias lines, each bias line electrically connected to at least one bias line solder pad;

wherein said switch element control inputs are applied to one or more bias lines of said plurality of bias lines.

25. The switch matrix according to claim 13, wherein said RF substrate layer or said bias line layer comprise multiple layers fabricated using multiple layer circuit board techniques.

26. The switch matrix according to claim 13, wherein said RF substrate layer and said bias line layer comprise a multiple layer motherboard fabricated using multiple layer circuit board techniques.

27. The switch matrix according to claim 14, wherein microstrip lines disposed on said RF substrate layer couple row outputs of at least a portion of said plurality of switch element tiles to row inputs of adjacent switch element tiles and microstrip lines disposed on said RF substrate layer couple column outputs on at least a portion of said plurality of switch element tiles to column inputs of adjacent switch element tiles.

28. The switch matrix according to claim 27, wherein the row output of each switch element tile not coupled to the row input of an adjacent switch element tile or to one of said multiple signal outputs is coupled to a chip terminator, the column output of each switch element tile not coupled to the column input of an adjacent switch element tile or to one of said multiple signal outputs is coupled to a chip terminator, the row input of each switch element tile not coupled to the row output of an adjacent switch element tile or to one of said multiple signal inputs is coupled to a chip terminator, and the column input of each switch element tile not coupled to the column output of an adjacent switch element tile or to one of said multiple signal inputs is coupled to a chip terminator.

29. A method for connecting various ones of M inputs to various ones of N outputs comprising the steps of:

providing a plurality of crosspoint switch tiles, each crosspoint switch tile having a row input, a column input, a row output, and a column output and each crosspoint switch tile being switchably operable to couple said row input to said row output or said column output and to couple said column input to said row output or said column output;

disposing said plurality of crosspoint switch tiles on an upper side of a radio frequency (RF) substrate, said upper side of said RF substrate having a plurality of microstrip lines;

arranging said plurality of crosspoint switch tiles on said RF substrate in rows and columns, wherein the row input of each crosspoint switch tile in each row is electrically coupled to the row output of an adjacent crosspoint switch tile in the same row or to one input of said M inputs with at least one microstrip line of said plurality of microstrip lines and the column output of each crosspoint switch tile in each column is coupled to the column input of an adjacent crosspoint switch tile or to one output of said N outputs with at least one microstrip line of said plurality of microstrip lines;

receiving crosspoint switch signals at a bias line substrate disposed on a lower side of said RF substrate; and routing said crosspoint switch signals to said plurality of crosspoint switch tiles with control lines disposed on said bias line substrate and bias vias disposed within said RF substrate.

30. The method of claim 29 further comprising the steps of:

disposing at least one chip terminator at the row output of each crosspoint switch tile not electrically coupled to the row input of an adjacent crosspoint switch tile or to one output of said N outputs;

disposing at least one chip terminator at the column output of each crosspoint switch tile not electrically coupled to the column input of an adjacent crosspoint switch tile or to one output of said N outputs;

disposing at least one chip terminator at the row input of each crosspoint switch tile not electrically coupled to the row output of an adjacent crosspoint switch tile or to one input of said M inputs; and disposing at least one chip terminator at the column input of each crosspoint switch tile not electrically coupled to the column output of an adjacent crosspoint switch tile or to one input of said M inputs.

31. The method of claim 29 wherein at least one crosspoint switch tile comprises:

a substrate;

a first MEMS switch disposed on said substrate, said first MEMS switch switchably coupling said row input to said row output;

a second MEMS switch disposed on said substrate, said second MEMS switch switchably coupling said column input to said column output; and a third MEMS switch disposed on said substrate, said third MEMS switch switchably coupling said row input to said column output.

32. The method of claim 31 wherein said at least one crosspoint switch tile further comprises:

a first microstrip line disposed on said substrate, said microstrip line having a first input segment electrically coupled to said row input and having a first output segment electrically coupled to said row output, said first MEMS switch operable to electrically connect said first input segment to said first output segment;

a second microstrip line disposed on said substrate, said second microstrip line having a second input segment electrically coupled to said column input and having a second output segment electrically coupled to said column output, said second MEMS switch operable to electrically connect said second input segment to said second output segment, said second microstrip line being electrically isolated from said first microstrip line; and a third microstrip line disposed on said substrate, said third microstrip line having a third input segment electrically coupled to said row input and having a third output segment electrically coupled to said column output, said third MEMS switch operable to electrically connect said third input segment to said third output segment.

33. The method of claim 32, wherein said second microstrip line further comprises an airbridge to provide electrical isolation from said first microstrip line.

34. The method of claim 33, wherein said airbridge is fabricated using microwave monolithic integrated circuit techniques.

35. The method of claim 33, wherein said airbridge comprises one or more microstrip lines disposed on said RF substrate.

36. The method of claim 32, wherein said at least one crosspoint switch tile further comprises:

a first microstrip branch disposed on said substrate, said first microstrip branch being electrically coupled to said row input, said first input segment and said third input segment; and a second microstrip branch disposed on said substrate, said second microstrip branch being electrically coupled to said column output, said second output segment and said third output segment.

37. The method of claim 32, wherein said at least one crosspoint switch tile further comprises:

a row input pad disposed on said substrate, said row input pad coupled to said row input;

a row output pad disposed on said substrate, said row output pad coupled to said row output;

a column input pad disposed on said substrate, said column input pad coupled to said column input;

a column output pad disposed on said substrate, said column output pad coupled to said column output; and one or more solder bumps disposed on at least one pad of the group of pads consisting of said row input pad, said row output pad, said column input pad, and said column output pad.

38. The method of claim 29, wherein said RF substrate or said bias line substrate comprise multiple layers fabricated using multiple layer circuit board techniques.

39. The method of claim 29, wherein said RF substrate and said bias line substrate comprise a multiple layer motherboard fabricated using multiple layer circuit board techniques.

* * * * *